US010557188B2

(12) United States Patent
Parson et al.

(10) Patent No.: US 10,557,188 B2
(45) **Date of Patent: *Feb. 11, 2020**

(54) ALUMINUM ALLOY COMPOSITION AND METHOD

(71) Applicant: Rio Tinto Alcan International Limited, Montreal (CA)

(72) Inventors: Nicholas C. Parson, Kingston (CA); Greg Lea, Poland, OH (US)

(73) Assignee: Rio Tinto Alcan International Limited, Montreal (CA)

( * ) Notice: Subject to any disclaimer, the term of this patent is extended or adjusted under 35 U.S.C. 154(b) by 513 days.

This patent is subject to a terminal disclaimer.

(21) Appl. No.: 14/662,742

(22) Filed: Mar. 19, 2015

(65) Prior Publication Data

US 2018/0016665 A1 Jan. 18, 2018

Related U.S. Application Data

(60) Provisional application No. 61/955,516, filed on Mar. 19, 2014.

(51) Int. Cl.
*C22F 1/04* (2006.01)
*C22C 21/00* (2006.01)

(52) U.S. Cl.
CPC ..... *C22F 1/04* (2013.01); *C22C 21/00* (2013.01)

(58) Field of Classification Search
CPC ..... C22F 1/04; C22C 21/00
See application file for complete search history.

(56) References Cited

U.S. PATENT DOCUMENTS 5,286,316 A 2/1994 Wade
6,458,224 B1 10/2002 Ren et al.
6,638,376 B2 10/2003 Hasegawa et al.
6,656,296 B2 12/2003 Ren et al.
7,211,160 B2 5/2007 Hasegawa et al.
(Continued)

FOREIGN PATENT DOCUMENTS

WO 2012/098991 A1 7/2012
WO 2013/146686 A1 10/2013

OTHER PUBLICATIONS

'Aluminum and Aluminum Alloys', ASM International, 1993, p. 21, 44. (Year: 1993).*

*Primary Examiner* — George Wyszomierski
*Assistant Examiner* — Janell C Morillo
(74) *Attorney, Agent, or Firm* — Banner & Witcoff, Ltd.

(57) ABSTRACT

An aluminum alloy composition includes, in weight percent:

0.5-0.7 manganese;
0.05-0.15 iron;
0.3-0.5 silicon;
0.020 max nickel;
0.05-0.15 titanium;
0.01 max copper; and
0.10 max zinc, with the balance being aluminum and unavoidable impurities. The alloy may also have a combined amount of manganese and silicon of at least 0.8 wt. % and/or a Mn/Si ratio of 2.25 or less. The alloy may tolerate higher nickel contents than existing alloys, while providing increased corrosion resistance, as well as similar extrudability, strength, and performance. Billets or other intermediate products formed of the alloy may be homogenized at 500-595° C. and controlled cooled at 400° C. per hour or less. The homogenized billet may be extruded into an extruded product, such as an aluminum alloy heat exchanger tube.

22 Claims, 1 Drawing Sheet

(56) References Cited

U.S. PATENT DOCUMENTS

| | | | | |
|---|---|---|---|---|
| 7,732,059 | B2 | 6/2010 | Ren et al. | |
| 7,767,042 | B2 | 8/2010 | Hasegawa et al. | |
| 2008/0050269 | A1* | 2/2008 | Tanaka | C22C 21/00<br>420/537 |
| 2014/0083569 | A1 | 3/2014 | Parson et al. | |
| 2015/0060035 | A1 | 3/2015 | Furumura et al. | |

* cited by examiner

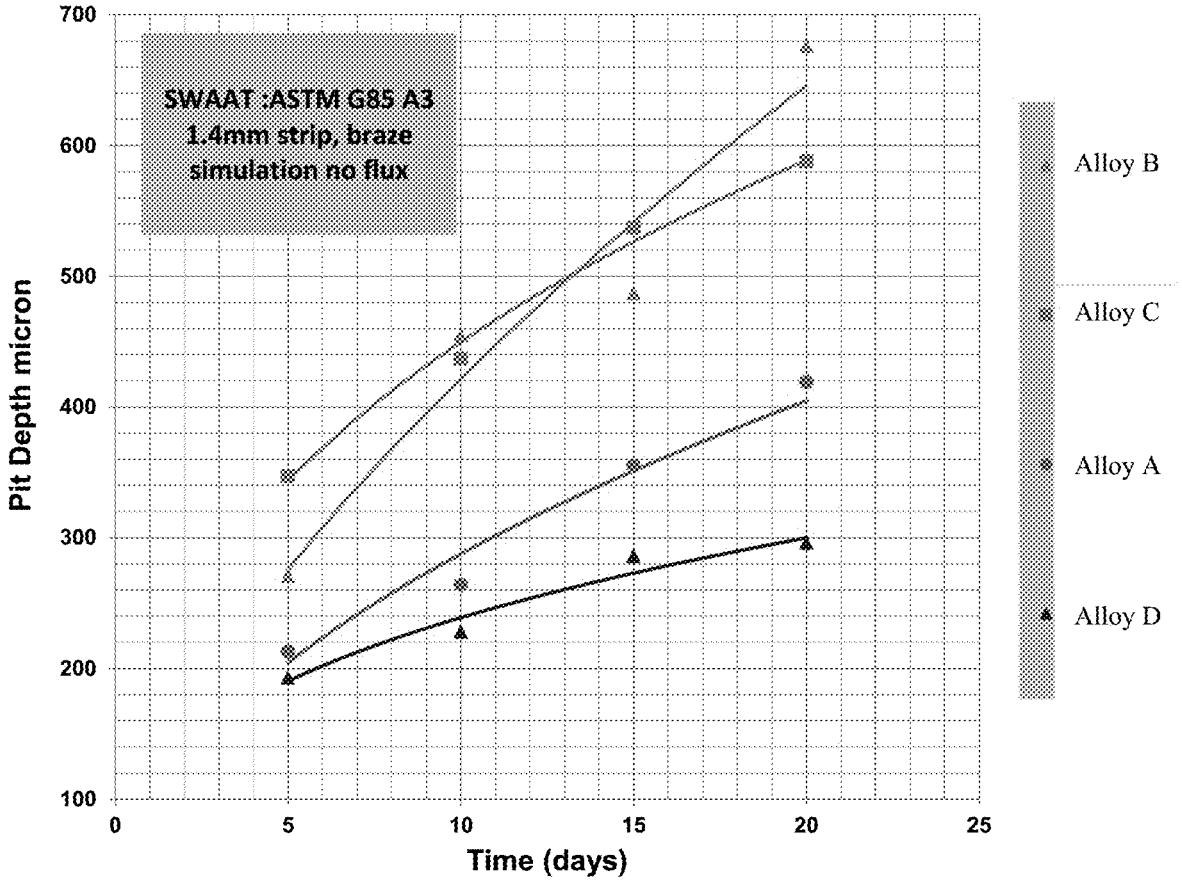
SWAAT :ASTM G85 A3
1.4mm strip, braze
simulation no flux
Pit Depth micron
700
600
500
400
300
200
100
0
5
10
15
20
25
Time (days)
Alloy B
Alloy C
Alloy A
Alloy D

ALUMINUM ALLOY COMPOSITION AND METHOD

CROSS-REFERENCE TO RELATED APPLICATION

This application is a non-provisional of and claims priority to U.S. Provisional Application No. 61/955,516, filed Mar. 19, 2014, which application is incorporated by reference herein in its entirety and made part hereof.

TECHNICAL FIELD

The invention relates generally to an aluminum alloy composition and methods of manufacturing and/or homogenizing that can be used with the composition, and more specifically, to an Al—Mn—Si—Ti alloy composition with good corrosion resistance and extrudability, as well as tolerance to increased Ni impurity levels.

BACKGROUND

The use of aluminum in heat exchangers is now widespread in applications such as automotive, off road equipment and heating ventilation and air conditioning (HVAC) systems. Extruded tubing is often used due to the ability to produce complex thin wall geometries such as mini microport (MMP) tubing which improves heat transfer. Such tubes are typically connected to fins and headers/manifolds to create the heat exchanger using controlled atmosphere brazing (CAB). Resistance to failure by pitting corrosion is an important property of these units which can be subjected to corrosive environments such as road salt, coastal environments and industrial pollutants. At the same time, the expectations in terms of lifetimes of the units and customer warranties are increasing and there is a continuing need to improve the corrosion performance of such systems. The extruded tubing is typically the thinnest walled component of such heat exchangers and the most likely to fail by corrosion first. Often the tubes are zincated either by thermal arc spray or by roll coating with a zinc containing flux which adds a measure of sacrificial corrosion protection. However, the inherent corrosion resistance of the underlying tube material remains a key component of the protection mechanism, particularly when the sacrificial Zn rich layer has been removed by corrosion.

The present composition and method are provided to address the problems discussed above and other problems, and to provide advantages and aspects not provided by prior compositions and methods of this type. A full discussion of the features and advantages of the present invention is deferred to the following detailed description, which proceeds with reference to the accompanying drawings.

BRIEF SUMMARY

The following presents a general summary of aspects of the invention in order to provide a basic understanding of the invention. This summary is not an extensive overview of the invention. It is not intended to identify key or critical elements of the invention or to delineate the scope of the invention. The following summary merely presents some concepts of the invention in a general form as a prelude to the more detailed description provided below.

Aspects of the present disclosure relate to an aluminum alloy composition that includes, in weight percent:

0.5-0.7 manganese;
0.05-0.15 iron;
0.3-0.5 silicon;
0.020 max nickel;
0.05-0.15 titanium;
0.01 max copper; and
0.10 max zinc, with the balance being aluminum and unavoidable impurities. The unavoidable impurities may have a content of no more than 0.05 wt. % per impurity and 0.15 wt. % total. The alloy includes manganese and silicon in a Mn/Si ratio of 2.25 or less. According to various aspects, the manganese content may be 0.60-0.70 wt. %, the silicon content may be 0.35-0.50 wt. %, and/or the nickel content may be at least 0.005 wt. %.

According to one aspect, the combined amount of manganese and silicon in the alloy is at least 0.8 wt. %, and/or the alloy includes manganese and silicon in a Mn/Si ratio of less than 2.25.

Additional aspects of the disclosure relate to an aluminum alloy intermediate product (e.g., a billet) formed of an aluminum alloy having a composition as described above.

According to one aspect, the intermediate product has a segregated microstructure with alternating areas of higher titanium content separated by areas of lower titanium content. The areas of higher titanium content may be spaced from each other by 20-80 microns in one embodiment.

Further aspects of the disclosure relate to a method that includes casting an intermediate product of an aluminum alloy composition as described above, homogenizing the intermediate product, controlled cooling the intermediate product after homogenizing, and extruding the homogenized and controlled cooled intermediate product to form an extruded aluminum alloy product. The homogenization is performed at a homogenization temperature of 500° C. to 595° C., and the controlled cooling is performed at a rate of 400° C. per hour or less, down to a temperature of 400° C. or less.

According to various aspects, the homogenization may be performed in a continuous homogenization furnace, and the homogenization temperature may be 540° C. to 590° C., or about 580° C.

Still further aspects of the disclosure relate to an extruded aluminum alloy product formed of an aluminum alloy having a composition as described above. The extruded product may be formed from a billet or other intermediate product as described above and/or may be formed using a method as described above. The extruded product may be a heat exchanger tube in one embodiment.

According to one aspect, the extruded product has a microstructure with alternating bands of higher titanium content material and lower titanium content material oriented parallel to a surface of the product.

According to another aspect of the extruded product and/or the method described above, the extruded product may be brazed, and the extruded product after extrusion and brazing exhibits a through-thickness grain size of 150 microns or less.

Other features and advantages of the invention will be apparent from the following description taken in conjunction with the attached drawings.

BRIEF DESCRIPTION OF THE DRAWING

To allow for a more full understanding of the present invention, it will now be described by way of example, with reference to the accompanying drawings in which:

FIG. 1 is a graphical representation of corrosion data obtained by SWAAT testing of various alloys.

DETAILED DESCRIPTION

In general, a corrosion resistant Al—Mn—Si—Ti alloy composition is provided, which can be extruded into a heat exchanger tube while at the same time exhibiting tolerance to increased Ni impurity levels and improved extrudability compared to other corrosion resistant alloys. The aluminum alloy enables increased corrosion resistance of extruded and brazed heat exchanger tubes. A method of manufacturing heat exchanger tubing or another article from such an alloy composition is also provided, including homogenizing the alloy composition prior to extrusion. The aluminum alloy also is able to be homogenized using continuous homogenization techniques.

In one embodiment, an extrudable aluminum alloy composition may comprise, consist of, or consist essentially of, in weight percent:

Mn 0.5-0.7;
Fe 0.05-0.15;
Si 0.3-0.5;
Ni 0.020 max;
Ti 0.05-0.15; and
Cu 0.01 max, with the balance being aluminum and unavoidable impurities. Each unavoidable impurity is present at less than 0.05 wt. % and the total impurity content is less than 0.15 wt. %.

In one embodiment, zinc may be present in the alloy at less than 0.10 wt. %, and in other embodiments, the zinc content may be less than 0.05 wt. %, less than 0.03 wt. %, or less than 0.01 wt. %. In another embodiment, the alloy is free or essentially free of zinc, and/or may have no intentional or deliberate addition of zinc.

In one embodiment, the copper content of the alloy may be less than 0.01 wt. %. In another embodiment, the alloy may be free or essentially free of copper, and/or may have no intentional or deliberate addition of copper.

In one embodiment, the iron content of the alloy may be 0.05-0.25 wt. %. In another embodiment, the iron content of the alloy may be 0.05-0.15 wt. %. In a further embodiment, the iron content of the alloy may be 0.08-0.15 wt. %.

In one embodiment, the silicon content of the alloy may be 0.3-0.5 wt. % or 0.35-0.5 wt. %. Additionally, in one embodiment, the manganese content of the alloy may be 0.5-0.7 wt. %. The total combined amount of Mn+Si in the alloy may be at least 0.8 wt. % in one embodiment. Additionally or alternately, the ratio of the Mn/Si content of the alloy may be 2.25 or less according to one embodiment, or 2.0 or less according to another embodiment.

In one embodiment, the titanium content of the alloy may be 0.05-0.15 wt. %. In other embodiments, the titanium content may be 0.05-0.14 wt. %, 0.05-0.12 wt. %, or 0.10-0.15 wt. %.

As mentioned above, the alloy can have increased tolerance to Ni impurity levels compared to other alloys, and may tolerate Ni contents of up to 0.020 wt. % in one embodiment. In another embodiment, the nickel content of the alloy may be up to 0.015 wt. %. In another embodiment, the lower limit for Ni in the alloy is 0.005 wt. %, and the Ni content may be 0.005-0.020 wt. %, or 0.005-0.015 wt. %. In yet another embodiment, the lower limit for Ni in the alloy is 0.008 wt. %, and the Ni content may be 0.008-0.020 wt. %, or 0.008-0.015 wt. %. In a further embodiment, the lower limit for Ni in the alloy is 0.010 wt. %, and the Ni content may be 0.010-0.020 wt. %, or 0.010-0.015 wt. %.

The aluminum alloy composition can be used to manufacture extruded products, and according to some embodiments, it is particularly suitable for making extruded heat exchanger tubing.

A method for manufacturing heat exchanger tubing or another article from an alloy composition as described above may include homogenization of the alloy prior to extrusion into heat exchanger tubing. The alloy may be used in forming a variety of different articles, and may be initially produced as an intermediate casting product. The term "intermediate product" as used herein may refer to billets, as well as ingots and other semi-finished products that may be produced via a variety of techniques, including casting techniques such as continuous or semi-continuous casting and others.

In one embodiment, the aluminum alloy composition, in for example the form of an intermediate product, is homogenized at temperatures 595° C. or less. In another embodiment, the homogenization temperature may be 590° C. or less, or 580° C. or less. The homogenization temperature may also be at least 500° C. or at least 540° C., with upper limits as described above, in various embodiments. In one embodiment, the homogenization temperature may be about 580° C. Homogenization may be carried out for 2-8 hours in one embodiment. Additionally, these relatively low homogenization temperatures permit homogenization of the alloy to be carried out in a continuous homogenization furnace, which utilizes lower homogenization temperatures and faster cooling rates in one embodiment. It is understood that this alloy may also be homogenized using different techniques, including a batch homogenization technique.

After homogenization, the homogenized alloy may then be controlled cooled at a rate of 400° C./hr or less in one embodiment, or 100-400° C./hr in another embodiment. This controlled cooling may be performed until the alloy reaches room temperature in one embodiment, or until the alloy reaches 300° C. or 400° C. in other embodiments.

After homogenization, the intermediate product can be formed into an article of manufacture using various metal processing techniques, such as extrusion, forging, rolling, machining, casting, etc. For example, extruded articles may be produced by extruding the alloy to form the extruded article. It is understood that an extruded article may have a constant cross section in one embodiment, and may be further processed to change the shape or form of the article, such as by cutting, machining, connecting other components, or other techniques. As described above, the alloy may be extruded to form heat exchanger tubing or other tubing in one embodiment, and the tubing may have a diffusion surface layer applied or be clad in various other metals. For example, the tubing may have a zinc diffusion layer, which may be applied by thermal arc spray (e.g., as the extrusion emerges from the die) or a zinc-containing braze flux applied to the tube surface after extrusion (e.g., by roll coating) or other method, and/or may be clad in a brazing alloy, or other cladding materials. The tubing may then be brazed or welded to another component of the heat exchanger.

Alloys according to the embodiments described above utilize a titanium addition to improve the corrosion resistance through a peritectic segregation layering mechanism. During solidification, the titanium atoms segregate preferentially towards the dendrite centers, resulting in a composition distribution across the microstructure including alternating areas of higher and lower Ti content, on the scale of the dendrite arm spacing, e.g., 20-80 microns in one embodiment (which may depend on the billet diameter). For example, titanium levels can vary from almost zero at areas of lowest concentration to about 0.40 wt. % areas of highest concentration within the alloy. Extrusion of this structure results in alternating bands or lamellae of high and low titanium concentration material parallel to the tube surface. Generally, the bands or lamellae may have thicknesses and spacing that are significantly less than the dendrite arm spacing, depending on extrusion ratio. Without being bound by theory, it is believed that this inhibits pitting by promoting lateral attack parallel to the tube surface, when used as heat exchanger tubing. Control of Fe and Cu impurities can also contribute to the corrosion resistance of the alloy.

The titanium addition in the alloy is mainly in solid solution in the microstructure. This can significantly increase the flow stress and extrusion pressure at extrusion temperature, reducing extrudability and limiting the extrusion speed and die life. The use of titanium in the levels described above (e.g., 0.05-0.15 wt. %) decreases the detrimental effect of the titanium additions. Additionally, these titanium levels have been found to increase corrosion resistance in alloys, relative to similar alloys having higher titanium levels, as described in the Example below. The relatively low manganese content of the alloy also provides lower flow stress, which contributes to improved extrudability. Good extrudability can reduce the cost of production of extruded products, not only by allowing high extrusion speeds to be achieved, thus improving productivity, but also by increasing die life and providing a better extruded surface, which results in fewer defects during brazing.

The higher Si contents, lower Mn contents, or lower Mn/Si ratio of the alloy described herein, as well as the homogenization treatment described above was found to produce a fine grain structure after brazing, which is beneficial for corrosion resistance. In one embodiment, the alloy after extrusion and brazing exhibits a through-thickness grain size of 150 microns or less, or 100 microns or less. In other embodiments, the through-thickness grain size may be 75 microns or less, or about 50 microns. The linear intercept method is one suitable method for determining this grain size. It is contemplated that this occurs due to production of a high density of Al—Mn—Si precipitates during homogenisation, as a result of the manganese and silicon levels and the homogenization treatment described herein. This promotes grain boundary pinning during the braze cycle, which in turn allows the fine as-extruded grain structure to be retained. As corrosion attack occurs primarily along grain boundaries in Al—Mn alloys, this type of structure provides a more tortuous path for the corrosion front to follow, and therefore reduces the depth of attack for a given exposure time.

The use of higher Si contents, lower Mn contents, or lower Mn/Si ratios, in combination with the homogenization described herein, also allows the alloy to be homogenized in continuous homogenization furnaces, which is readily available equipment. Treatments above the temperature ranges specified herein (e.g., above 595° C.) typically have to be performed in batch type furnaces, which are less readily available. Typically, Al—Mn extrusion billets homogenized in a batch system are cooled slowly to precipitate Mn from solid solution and decrease the alloy flow stress. Continuous homogenization practices typically involve higher cooling rates, and the slow cooling practices necessary to achieve this decreased flow stress in existing Al—Mn extrusion alloys can be more difficult to achieve. The alloy described herein has lower levels of Mn in solution, due to the lower total Mn addition, as well as reduced Mn solubility due to the higher Si content. This allows faster cooling rates to be applied without a significant effect on the extrudability of the alloy. This, in turn, allows the alloy to be homogenized in the more common continuous homogenization furnace, enabling the alloy to be produced in a greater number of locations, reducing the cost of homogenization, and improving the consistency of the product.

Example 1

The alloys in Table 1 were DC cast as 101-mm diameter extrusion ingots. Billets of the four alloys in Table 1 were homogenized for 4 hours at 620° C. and cooled at less than 200° C./hr.

TABLE 1

| Alloy Compositions | | | | | | | |
|---|---|---|---|---|---|---|---|
| Alloy | Cu | Fe | Mn | Ni | Si | Ti | Zn |
| A | 0.002 | 0.11 | 0.78 | 0.006 | 0.23 | 0.17 | 0.002 |
| B | 0.002 | 0.44 | 0.23 | 0.005 | 0.07 | 0.018 | 0.021 |
| C | 0.08 | 0.56 | 1.05 | 0.007 | 0.25 | 0.016 | 0.005 |
| D | 0.002 | 0.11 | 0.79 | 0.006 | 0.23 | 0.12 | 0.004 |

The billets were then extruded on an 780-tonne extrusion press using a billet temperature of 500° C. and a ram speed of 6 mm/s into a 30×1.4 mm strip at an extrusion ratio of 210/1. The strip was water quenched upon leaving the die to simulate industrial practice. The tube was then cut into 100-mm coupons, and a thermal treatment was then applied for 120 seconds at 600° C. to simulate a typical CAB braze cycle. The coupons were then exposed in a corrosion cabinet to a SWAAT environment (ASTM G85 A3). A total of 16 coupons per alloy were exposed and 4 samples of each alloy were removed after 5, 10, 15, and 20 days exposure. The coupons were cleaned by immersing in 20% nitric acid solution to remove the corrosion products. The six deepest pits on each coupon were identified, and the depths were measured using an optical microscope to focus on the bottom of the pit, consistent with ASTM G46. The average pit depth was then calculated for each alloy and for each SWAAT exposure time.

The corrosion results are presented graphically in FIG. 1. While the alloys tested are not within the compositions described herein, this testing illustrates that a Ti content of 0.12 wt. % gives improved corrosion resistance compared to a similar alloy with 0.17 wt. % Ti. Subsequent metallographic examination revealed that this effect was probably due to the presence of fine (1-5 microns) primary $TiAl_3$ intermetallics in the alloy microstructure at the higher Ti level. Such particles can act as strong cathodes to drive the pitting mechanism. This benefit achieved by having lower Ti levels is expected to be applicable to the compositions described herein (e.g., with Ti levels of 0.05-0.15 wt. %).

Example 2

Alloys B and D listed in Table 1 were DC cast as described above in Example 1, along with the other alloys identified in Table 2. Cut billets of these alloys were homogenized to the conditions given in Table 2, cooled at 300° C./hr, and then extruded on a 780 tonne extrusion press into 30×1.4 mm strips using a billet temperature of 480° C. and a ram speed of 6 mm/s. The strips were water quenched after leaving the die. Each strip was then cut into coupons and brazed, and corrosion testing was conducted on the coupons using the procedure described in Example 1. The mean pit depth values after 20 days exposure for each alloy are reported in Table 2, where the results are ranked in terms of highest to lowest pit depths, with a lower pit depth being more desirable to prevent perforation of extruded tubes.

TABLE 2

Alloy Compositions, Homogenization, and Corrosion Testing Results

| Alloy | Homogenisation | Cu | Fe | Mn | Ni | Si | Ti | Zn | 20 day pit depth |
|---|---|---|---|---|---|---|---|---|---|
| B | 4 hrs/580° C. | 0.002 | 0.44 | 0.23 | 0.005 | 0.07 | 0.02 | 0.020 | 639 |
| F | 4 hrs/580° C. | 0.003 | 0.11 | 0.98 | 0.008 | 0.09 | 0.02 | 0.020 | 446 |
| L | 2 hrs/580° C. | 0.001 | 0.10 | 0.63 | 0.006 | 0.09 | 0.02 | 0.003 | 442 |
| D | 4 hrs/620° C. | 0.002 | 0.11 | 0.79 | 0.006 | 0.23 | 0.12 | 0.004 | 365 |
| H | 2 hrs/580° C. | 0.001 | 0.13 | 0.60 | 0.006 | 0.41 | 0.12 | 0.002 | 342 |
| K | 2 hrs/580° C. | 0.001 | 0.12 | 0.70 | 0.006 | 0.31 | 0.11 | 0.002 | 313 |
| G | 2 hrs/580° C. | 0.001 | 0.13 | 0.60 | 0.006 | 0.31 | 0.12 | 0.002 | 310 |
| I | 2 hrs/580° C. | 0.001 | 0.12 | 0.70 | 0.006 | 0.10 | 0.11 | 0.002 | 294 |
| J | 2 hrs/580° C. | 0.001 | 0.12 | 0.70 | 0.006 | 0.20 | 0.11 | 0.002 | 281 |

Alloy B, which is a typical AA3102 composition widely used for extruded condenser tubing, gave the greatest pit depth, as was also the case in Example 1. Alloy F, without a deliberate Ti addition, is a commercially-available "long life" extruded condenser tube material. Alloy F is considered a benchmark material for corrosion and extrusion performance for purposes of this Example, or in other words, an alloy that offered corrosion performance and extrusion performance at least as good as Alloy F could be considered a possible replacement or alternate material for Alloy F.

Alloy L has no deliberate Ti addition, similarly to Alloy F, and is designed to be more extrudable by reduction of the Mn content. Alloy L exhibited similar corrosion performance to Alloy F.

Alloy D, with a deliberate Ti addition below 0.15 wt. %, produced an improvement in corrosion performance compared to the Alloy F baseline. However, this material was homogenized at 620° C., which is not compatible with continuous homogenization equipment widely used for 6XXX alloy production.

Experimental Alloys G-K all had Mn contents of 0.60-0.70 wt. %, Si contents of 0.10-0.41 wt. %, and a Ti addition of <0.15 wt. %. These alloys exhibited slight or significant improvements in corrosion resistance compared to Alloy D, and all were significantly superior to Alloy F in corrosion resistance. This suggests that these alloys could be successfully used as replacements for Alloy F in terms of corrosion performance. The homogenisation cycle of 2 hrs/580° C. is highly compatible with continuous homogenization equipment. Alloys G-K also contained 0.006 wt. % Ni, indicating their corrosion performance is tolerant of this level of Ni as an impurity.

Example 3

The alloys in Table 2 above were DC cast as described above in Example 1, along with a further alloy (Alloy M) that includes 0.002 wt. % Cu, 0.11 wt. % Fe, 1.01 wt. % Mn, 0.006 wt. % Ni, 0.23 wt. % Si, 0.16 wt. % Ti, and 0.002 wt. % Zn. Cut billets of these alloys were homogenized at the homogenization conditions identified in Table 3, cooled at 300° C./hr, and then extruded on the same 780 tonne extrusion press into a 3×42 mm profile using a billet temperature of 450° C. and a ram speed of 12 mm/s. Four billets of scrap material were used to stabilize the extrusion press thermally before the test billets were introduced. The ram pressure at press breakthrough was recorded and is listed in Table 3, along with the % differential as compared to the "benchmark" Alloy F, which contained 1.0 wt. % Mn.

TABLE 3

Extrusion Testing Results

| Billet No | Alloy | Homogenisation hrs/° C. | Mn wt % | Si wt % | Ti wt % | Pmax psi | Δ% alloy F % |
|---|---|---|---|---|---|---|---|
| 1 | B | 4-580 | 0.23 | 0.07 | 0.02 | 1206 | −14.3 |
| 2 | G | 2-580 | 0.6 | 0.31 | 0.12 | 1237 | −12.1 |
| 3 | H | 2-580 | 0.6 | 0.41 | 0.12 | 1407 | 0.0 |
| 4 | I | 2-580 | 0.7 | 0.1 | 0.11 | 1366 | −2.9 |
| 5 | F | 4-580 | 0.98 | 0.11 | 0.02 | 1407 | 0 |
| 6 | J | 2-580 | 0.7 | 0.2 | 0.11 | 1371 | −2.6 |
| 7 | K | 2-580 | 0.7 | 0.31 | 0.11 | 1405 | −0.1 |
| 8 | D | 4-620 | 0.79 | 0.23 | 0.12 | 1332 | −5.3 |
| 9 | M | 4-580 | 1.01 | 0.23 | 0.16 | 1461 | 3.8 |

The breakthrough pressure is a widely used measure of extrudability, and typically an Al—Mn alloy with a lower breakthrough pressure can be extruded faster until the capacity of a given press is exceeded. A lower breakthrough pressure also typically results in less heat generation and allows extrusion die surfaces to run at lower temperatures, which prolongs tooling life. Thus, a reduced breakthrough pressure is typically considered to indicate improved extrudability in alloys of this type.

Alloy B exhibited the lowest extrusion pressure, due to the very low Mn content. However, as described above, Alloy B did not exhibit good corrosion resistance.

Alloy M, with an addition of Ti and increased Si compared to Alloy F and the same homogenization parameters as Alloy F, actually resulted in higher extrusion pressure. This indicates that these alloying additions are detrimental to extrudability, at least at the Mn levels in Alloys M and F.

Alloy D also exhibited lower pressure than Alloy F. However, as described above, the use of this homogenization cycle (at 620° C.) is not practical for continuous homogenization equipment.

The experimental Alloys G-K all required lower breakthrough pressure than the "benchmark" Alloy F. This indicates that the corrosion resistance benefits identified for these Ti-containing alloys in Example 2 above can be achieved without a loss of extrudability, and may even produce improved extrudability. As described above, Alloys G-K all had Mn contents of 0.60-0.70 wt. %, Si contents of 0.10-0.41 wt. %, and a Ti addition of <0.15 wt. %, and the homogenization cycle of these alloys (at 580° C.) is highly compatible with current continuous homogenization equipment.

The alloy composition of the present invention may be used advantageously wherever corrosion resistance is required, particularly when combined with the homogenization treatment as described above. This includes not only the production of extruded and brazed heat exchanger tubing, but also non-brazed heat exchanger tubing and general extrusion applications, as well as sheet products, including tube manufactured from folded sheet, in various embodiments. The alloy can be extruded at similar or improved production rates as existing commercial extrusion alloys, and can be homogenized using continuous homogenization techniques, increasing productivity and versatility. The alloy also exhibits tolerance to increased Ni impurity levels. Still other benefits and advantages are recognizable to those skilled in the art.

While the invention has been described with respect to specific examples including presently preferred modes of carrying out the invention, those skilled in the art will appreciate that there are numerous variations and permutations of the above described systems and methods. Thus, the spirit and scope of the invention should be construed broadly as set forth in the appended claims. All compositions herein are expressed in weight percent, unless otherwise noted. It is understood that any of the ranges (e.g., compositions) described herein may vary outside the exact ranges described herein, such as by up to 5% of the nominal range endpoint, without departing from the present invention. In one embodiment, the term "about" may be used to indicate such variation.

What is claimed is:

1. An extruded aluminum alloy product formed of an aluminum alloy having a composition consisting essentially of, in weight percent:

0.5-0.7 manganese;
0.05-0.15 iron;
0.3-0.5 silicon;
0.005-0.020 nickel;
0.05-0.15 titanium;
0.01 max copper; and
0.10 max zinc,
with the balance being aluminum and unavoidable impurities, wherein the alloy includes manganese and silicon in a Mn/Si ratio of 2.25 or less,
wherein the extruded product is formed of an intermediate aluminum alloy product that was homogenized in a single homogenization step at a homogenization temperature of 500° C. to 595° C.

2. The extruded aluminum alloy product of claim 1, wherein the combined amount of manganese and silicon in the alloy is at least 0.8 wt. %.

3. The extruded aluminum alloy product of claim 1, wherein the unavoidable impurities in the alloy have a content, in weight percent, of no more than 0.05 per impurity and 0.15 total.

4. The extruded aluminum alloy product of claim 1, wherein the manganese content of the alloy is 0.60-0.70 wt. %.

5. The extruded aluminum alloy product of claim 1, wherein the silicon content of the alloy is 0.35-0.50 wt. %.

6. The extruded aluminum alloy product of claim 1, wherein the product has a segregated microstructure with alternating areas of higher titanium content separated by areas of lower titanium content.

7. The extruded aluminum alloy product of claim 6, wherein the areas of higher titanium content are spaced from each other by 20-80 microns.

8. The extruded aluminum alloy product of claim 1, wherein the product has a microstructure with alternating bands of higher titanium content material and lower titanium content material oriented parallel to a surface of the product.

9. The extruded aluminum alloy product of claim 1, wherein the product is a heat exchanger tube.

10. The extruded aluminum alloy product of claim 1, wherein the extruded aluminum alloy product is a mini-microport heat exchanger tube.

11. A method comprising:

casting an intermediate product of an aluminum alloy composition consisting essentially of, in weight percent:

0.5-0.7 manganese;
0.05-0.15 iron;
0.3-0.5 silicon;
0.005-0.020 nickel;
0.05-0.15 titanium;
0.01 max copper; and
0.10 max zinc,
with the balance being aluminum and unavoidable impurities, wherein the alloy includes manganese and silicon in a Mn/Si ratio of 2.25 or less;

homogenizing the intermediate product in a single homogenization step at a homogenization temperature of 500° C. to 595° C.;

controlled cooling the intermediate product after homogenizing at a rate of 400° C. per hour or less, down to a temperature of 400° C. or less; and extruding the homogenized and controlled cooled intermediate product to form an extruded aluminum alloy product.

12. The method of claim 11, wherein the homogenization is performed in a continuous homogenization furnace.

13. The method of claim 11, wherein the homogenization temperature is 540° C. to 590° C.

14. The method of claim 11, wherein the homogenization temperature is about 580° C.

15. The method of claim 11, wherein the extruded aluminum alloy product is a heat exchanger tube.

16. The method of claim 11, further comprising brazing the extruded aluminum alloy product, wherein the extruded product after extrusion and brazing exhibits a through-thickness grain size of 150 microns or less.

17. The method of claim 11, wherein the unavoidable impurities in the alloy have a content, in weight percent, of no more than 0.05 per impurity and 0.15 total.

18. The method of claim 11, wherein the extruded aluminum alloy product is a mini-microport heat exchanger tube.

19. An extruded aluminum alloy product formed of an aluminum alloy composition consisting essentially of, in weight percent:

0.5-0.7 manganese;
0.05-0.15 iron;
0.3-0.5 silicon;
0.005-0.020 nickel;
0.05-0.15 titanium;
0.01 max copper; and
0.10 max zinc,
with the balance being aluminum and unavoidable impurities, wherein the alloy includes manganese and silicon in a Mn/Si ratio of 2.25 or less.

20. The extruded aluminum alloy product of claim 19, wherein the unavoidable impurities in the alloy have a content, in weight percent, of no more than 0.05 per impurity and 0.15 total.

21. The extruded aluminum alloy product of claim 19, wherein the extruded aluminum alloy product is a heat exchanger tube.

22. The extruded aluminum alloy product of claim 19, wherein the extruded aluminum alloy product is a mini-microport heat exchanger tube.

* * * * *